US010066609B2

(12) United States Patent
Lavender et al.

(10) Patent No.: US 10,066,609 B2
(45) Date of Patent: Sep. 4, 2018

(54) VEHICLE

(71) Applicants: Artemis Intelligent Power Limited, Loanhead (GB); Danfoss Power Solutions APS, Nordborg (DK)

(72) Inventors: Jack Lavender, Loanhead (GB); Gordon Voller, Loanhead (GB)

(73) Assignees: Artemis Intelligent Power Ltd., Loanhead (GB); Danfoss Power Solutions Aps, Nordborg (DK)

( * ) Notice: Subject to any disclaimer, the term of this patent is extended or adjusted under 35 U.S.C. 154(b) by 570 days.

(21) Appl. No.: 14/648,918

(22) PCT Filed: Dec. 7, 2012

(86) PCT No.: PCT/GB2012/053061

§ 371 (c)(1),
(2) Date: Jun. 2, 2015

(87) PCT Pub. No.: WO2014/087119

PCT Pub. Date: Jun. 12, 2014

(65) Prior Publication Data

US 2015/0308419 A1 Oct. 29, 2015

(51) Int. Cl.
*F01B 1/06* (2006.01)
*F04B 1/04* (2006.01)
(Continued)

(52) U.S. Cl.
CPC ..... *F04B 1/0413* (2013.01); *F01B 1/0658* (2013.01); *F03C 1/0409* (2013.01); *F04B 1/0426* (2013.01); *F04B 1/053* (2013.01)

(58) Field of Classification Search
CPC ..... F04B 1/0426; F01B 1/0658
See application file for complete search history.

(56) References Cited

U.S. PATENT DOCUMENTS 4,223,595 A 9/1980 Ortelli
4,629,401 A 12/1986 Grote
(Continued)

FOREIGN PATENT DOCUMENTS

CN 85 1 06444 A 3/1987
CN 102341594 A 2/2012
(Continued)

OTHER PUBLICATIONS

International Search Report for PCT Application No. PCT/GB2012/053061 dated Jul. 10, 2013.

*Primary Examiner* — F. Daniel Lopez
(74) *Attorney, Agent, or Firm* — McCormick, Paulding & Huber LLP

(57) ABSTRACT

It is intended to provide a vehicle comprising a fluid working machine which can reduce wear of parts and be produced at low cost. The fluid working machine 11, 12 is provided with an eccentric cam 17, a piston 18A to 18F, a cylinder 19A to 19F, a drive rod 20A-20F having an engaging part 24 engaging with the piston and a contact part 25 contacting the eccentric cam 17, a holding member 34A to 34F surrounding the drive rod, a pressing member 40A to 40F for pressing up the holding member in a radially outward direction, and at least one holding ring 41 for holding the holding member from the outside.

20 Claims, 8 Drawing Sheets

(51) Int. Cl.
*F04B 1/053* (2006.01)
*F03C 1/30* (2006.01)

(56) References Cited

U.S. PATENT DOCUMENTS

| | | | | |
|---|---|---|---|---|
| 6,244,832 | B1 * | 6/2001 | Guentert | F04B 1/0408 417/269 |
| 2005/0265867 | A1 | 12/2005 | Djordjevic | |
| 2006/0110276 | A1 | 5/2006 | Djordjevic et al. | |

FOREIGN PATENT DOCUMENTS

| | | | |
|---|---|---|---|
| CN | 102616218 | A | 8/2012 |
| DE | 2915239 | A1 | 10/1980 |
| DE | 3424862 | C1 | 7/1985 |
| FR | 2392248 | A1 | 12/1978 |

* cited by examiner

VEHICLE

CROSS-REFERENCE TO RELATED APPLICATION

This application is entitled to the benefit of and incorporates by reference subject matter disclosed in International Patent Application No. PCT/GB2012/053061 filed on Dec. 7, 2012.

TECHNICAL FIELD

The present invention relates to a vehicle having a fluid working machine, such as a hydraulic motor, a hydraulic pump, a hydraulic pump-motor, which can function as a pump or a motor in alternative operating modes, or another kind of hydraulic actuator, such as a hydraulic ram.

BACKGROUND

Fluid working machines are employed in vehicles such as fork-lift trucks, loaders and excavators. Many such vehicles include hydraulic actuators, under operator control. In recent years some vehicles have been built with hydraulic drive transmissions, in which an internal combustion or electrical engine drives a hydraulic pump which delivers hydraulic fluid to hydraulic motors associated with each wheel.

U.S. Pat. No. 4,223,595 discloses a hydraulic motor having a plurality of drive rods arranged along a circumferential direction of an eccentric cam rotating with a rotation shaft. The drive rods are connected to corresponding pistons reciprocating in cylinders. In this hydraulic motor, by allowing an end of each drive rod to contact the eccentric cam, a reciprocating motion of the piston is converted into a rotation motion of the eccentric cam. Particularly, at one end of each drive rod, a holding member for holding a flange part is attached. The flange part of the holding member attached to each drive rod is fixed from outside by a ring member extending along the circumferential direction of the eccentric cam, thereby preventing the pistons from coming off from the eccentric cam.

U.S. Pat. No. 4,629,401 discloses a fluid working machine equipped with a spring member for pressing an end of each drive rod against the eccentric cam. In this fluid working machine, an end of the spring member is fixed to a nearby component and thus, the contact between the drive rod and the eccentric cam is maintained, thereby retaining the drive rod against the eccentric cam.

DE 2915239 discloses a fluid working machine equipped with a connection member for physically connecting the drive rod and the eccentric cam so that the drive rod stays in contact with the eccentric cam.

US 2006/0110276, discloses a fluid working machine that is designed in a way to maintain contact between the drive rod and the eccentric cam by pressing the drive rod against the eccentric cam using an elastic C-shaped member.

SUMMARY

The invention concerns apparatus to retain the cam contacting parts (e.g. sliding pads) of the drive rods against the eccentric cam.

In the fluid working machine of U.S. Pat. No. 4,223,595, the holding member provided at each drive rod is rigidly fixed by the ring member. Thus, if any of the parts is poorly manufactured, this creates a gap between the parts, leading to wear of the parts.

Further, in U.S. Pat. No. 4,223,595 the gap between the parts is filled using elastic deformation of the ring member. However, during the operation of the working fluid machine, periodic elastic deformation of the ring member in accordance with a rotation phase of the eccentric cam can lead to a higher risk of fatigue fracture. This is far more evident in a fluid working machine rotating at high speed.

In the fluid working machine of U.S. Pat. No. 4,629,401, one end of the spring member is fixed. Thus, during the operation of the working fluid machine, the spring member is compressed or extended significantly in accordance with the rotation phase of the eccentric cam and accordingly the force of pressing the drive rod against the eccentric cam changes significantly. Thus, although contact is maintained between the drive rod and the eccentric cam, the pressing force changes drastically. This is likely to cause wear thereof.

In the fluid working machine disclosed in DE 2915239, the connecting rod is rigidly fixed to the eccentric cam by the connection member and thus, it is necessary to manufacture each member with accordingly high precision.

In the fluid working machine disclosed in US 2006/0110276, the rotation of the eccentric cam causes the C-shaped member to deform significantly. The continuous deformation of the C-shaped member increases the risk of fatigue fracture.

The present seeks to provide a vehicle having a fluid working machine which addresses one or more of the problems with the prior art.

According to one embodiment of the present invention a vehicle may include, but is not limited to:

a hydraulic pump;

a hydraulic actuator which is driven by pressurized oil supplied from the hydraulic pump; and at least one of the hydraulic pump and the hydraulic actuator is a fluid working machine which includes, but not limited to:

an eccentric cam;

a plurality of pistons arranged radially around the eccentric cam;

a plurality of cylinders provided for the plurality of pistons, respectively, each of the pistons being configured to reciprocate along a radial direction of the eccentric cam by rotation of the eccentric cam;

a plurality of drive rods which are provided for the plurality of pistons, respectively, and wherein at least one of said drive rods comprises:

a main part that extends along a corresponding one of the cylinders;

an engaging part that is formed at one end of the main part and is engaged with corresponding one of the pistons; and a contact part that is formed at the other end of the main part and contacts the eccentric cam;

a at least one holding member that is arranged about the main part and extends along the axial direction of the drive rod;

at least one pressing member which presses the respective holding members, outward in the radial direction of the eccentric cam; and at least one holding ring which is arranged on the radially outwards side of a plurality of holding members to hold the plurality of holding members from the radially outwards of the holding members.

Within this description and the appended claims, by radially outwards (or radially outwardly) and radially inwards (or radially inwardly), we refer to further away from and closer to the rotation axis of the eccentric cam respectively.

The hydraulic actuator may be a hydraulic motor. The hydraulic actuator may be a hydraulic ram. Typically a load is coupled to the hydraulic actuator. The load may be a wheel. The load may be a fork-lift type actuator. A plurality of said hydraulic actuators (e.g. hydraulic motors each of which drives a respective wheel) may be driven by pressurized oil supplied by the hydraulic pump.

It may be that a plurality of the pressing members are pressed in a radially outwards direction by the pressing members while being held inwardly by the holding ring. Thus, the drive rods are pressed against the eccentric cam by a reaction force from the pressing members. In this manner, contact can be maintained between the drive rods and the eccentric cam with the proper pressing force. Therefore, it is possible to reduce wear of the drive rods as well as wear of the eccentric cam.

Further, the holding ring can be supported from the inside by the holding members being pressed in a radially outwards direction (the holding ring is preferably not rigidly fixed to any particular part) and thus, the pressing force of a rod being pressed against the eccentric cam can be maintained at an almost constant level, regardless of the rotation phase of the eccentric cam. In this manner, fluctuation of the pressing force against the eccentric cam can be reduced and it is therefore possible to reduce the wear of the drive rod and the eccentric cam.

Further, as a result of the elastic force of the pressing member, the gap generated between the parts can be filled. Therefore, it is unnecessary to manufacture each part with precision higher than necessary, thereby achieving lower manufacturing cost and also enhancing reliability and life time.

Typically, the vehicle comprises a motor and the hydraulic pump is driven by the motor.

Typically, the angle of the main part is changeable with respect to the axial direction of the corresponding one of the cylinders. The angle of the main part relative to the axial direction of the corresponding one of the cylinders may vary cyclically with rotation of the eccentric cam.

Typically, there is a gap between the majority or all of the holding members and the respective contact part. The gap distance enables each holding member to move slightly during operation, against the pressing force of respective pressing members. During operation the gap may close to zero for one holding member and the respective contact part during normal operation, as the pressing member is compressed. The gap on the opposite side of the cam for another holding member and respective contact part will correspondingly increase, as the holding ring allow the pressing member to expand. During abnormal operation, when the respective contact part could depart from the eccentric cam (because the force of the pressing member is overcome) the size of the gap is directly proportional to the distance by which the respective contact part moves away from the eccentric cam.

In one embodiment, at least one of the holding members may include a cylindrical part surrounding the main part and an inward flange part provided at the radially outwards end of the cylindrical part.

The contact part may have a diameter larger than the main part so that a stepped portion is formed between the contact part and the main part, and at least one of the pressing members may be arranged in an annular space formed between an inner surface of the cylindrical part and an outer surface of the main part to press the inward flange part in a direction apart from the stepped portion.

Further, at least one pressing member can be arranged in the annular space covered by the cylindrical part. Thus, during the operation of the fluid working machine, it is possible to prevent the pressing member from interfering with nearby parts, thereby attaining desirable reliability of the machine.

In one embodiment, at least one of the holding members may include a cylindrical part surrounding the main part and an outward flange part provided at the radially inwards end of the cylindrical part, and the at least one holding ring may hold the outward flange part of at least one of, preferably the majority of, even more preferred all of the holding members.

The outward flange part may be provided at the radially inwards end of the cylindrical part (on the side of the cylindrical part nearer to the eccentric cam). Thus, compared to the case where the outward flange part held by the holding member is formed at the radially outwards end of the cylindrical part (on the side of the cylindrical part farther from the eccentric cam), the attitude of the holding member held by the holding ring is stable.

Further, by forming the outward flange part at the radially inwards end of the cylindrical (on the side of the cylindrical part nearer to the eccentric cam), it is possible to reduce the diameter of the holding ring for holding the outward flange part, thereby attaining a more compact holding ring.

In an embodiment, at least one of the holding members may include a cylindrical part surrounding the main part and an outward flange part provided at the radially inwards end of the cylindrical part, and the fluid working machine further may include a plurality of slide members at least one of which is provided between the holding ring and the outward flange part of corresponding one of the holding members.

Typically, the holding ring is not fixed to the holding member and the holding ring can move relative to the holding member (the holding ring moves to some extent in the circumferential direction). It may be that in order to hold the holding member by the holding ring, a slide member is provided between the holding ring and the outward flange part where they contact with each other. As a result, it is possible to reduce the wear of the holding ring and the outward flange part, thereby attaching enhanced lifetime thereof.

In an embodiment, at least one of the slide members may be arranged around the cylindrical part and comprises at least one groove extending along the circumferential direction of the eccentric cam, and the at least one holding ring may be fitted in the at least one groove.

It may be that the position of the holding ring is regulated by the groove formed in the slide member. Thus, during the operation of the hydraulic motor, the holding ring is prevented from coming off from the holding member, resulting in improved reliability of the machine.

In an embodiment, the at least one holding member may comprise a pair of grooves on both sides of the cylindrical part, and the at least one holding ring may comprise a pair of holding rings which are fitted in the pair of grooves, respectively.

By holding the holding member by the holding ring from both sides of the cylindrical part in the above manner, the attitude of the holding member can be stable.

In an embodiment, at least one of the slide members may be fixed to the outward flange part of the corresponding one of the holding members by a clamp member or adhesive.

It may be that by fixing the slide member to the outward flange part of the holding member by a clamp member or adhesive, the slide member is kept on the holding member against a sliding force caused by the movement of the holding ring. Therefore, it is possible to enhance the life cycle.

In an embodiment, at least one of the slide members may be arranged around the holding member in a continuous fashion. By arranging the slide member over the entire outward flange part, it is possible to effectively reduce the wear of the holding ring and the holding member.

In an embodiment, at least one of slide members may be made of PEEK material.

In an embodiment, an inner passage may be formed in at least one piston and/or at least one drive rod to supply working fluid from the working chamber to a contact surface of the contact part with the eccentric cam.

It may be that the working fluid is supplied to the contact surface between the drive rod and the eccentric cam via the inner passage formed in at least one piston and/or at least one drive rod. The supplied working fluid forms a fluid film on the contact surface, thereby reducing the wear generated in the drive rod and the eccentric cam.

In an embodiment, an orifice may be provided in at least one inner passage to regulate a flow of the working fluid.

The flow of the operating oil to the contact surface may be regulated by the orifice so as to achieve desirable effect of wear reduction.

In an embodiment, at least one inner passage may include:

a first inner passage which is formed in the piston; and a second inner passage which is formed in at least one drive rod and communicate with the first inner passage, the working fluid being supplied from the working chamber to the contact surface via the first and second inner passages, and the first inner passage may have a greater cross-sectional area than the second inner passage.

It may be that the first inner passage has a greater cross-sectional area than the second inner passage. Thus, even when the drive rod is inclined with respect to the cylinder axis, it is possible to maintain the communication between the first inner passage and the second inner passage. As a result, it is possible to supply the working fluid to the contact surface regardless of the rotation phase of the eccentric cam, thereby reducing the wear of the contact surface effectively.

In an embodiment, a surface of at least one drive rod facing the eccentric cam may include a recessed portion which is surrounded by a stepped boundary around an opening of the inner passage and which is configured to function as a working fluid sump, the stepped boundary separating the recessed portion from the contact surface.

It may be that the surface of at least one drive rod facing the eccentric cam includes the working fluid sump. Thus, the working fluid stored in the working fluid sump is allowed to leak out to the contact surface via the inner passage. In this manner, the working fluid can spread effectively over the contact surface from the working fluid sump and thus, it is possible to reduce the wear in the contact surface more effectively.

In an embodiment, the working fluid sump may be formed so that a depth of the working fluid sump changes in a stepped manner in a circumferential direction of the eccentric cam.

It may be that the depth of the working fluid sump changes in a stepped manner in a circumferential direction around the eccentric cam. By this, it is possible to attain high strength of the contact part of the drive rod when the working fluid sump is formed by recessing the surface of the drive rod facing the eccentric cam.

In an embodiment, a surface of at least one drive rod facing the eccentric cam may include a groove to which the inner passage opens and which is configured to function as a working fluid sump.

It may be that, the working fluid leaks out from the groove extending in a prescribed direction, thereby spreading over the contact surface. By this, the wear in the contact surface is effectively reduced In an embodiment, the groove may surround a land.

It may be that the groove surrounds the land to form the working fluid sump and thus, the working fluid is positively introduced to the land surrounded by the groove. By this, the wear in the contact surface is effectively reduced.

In an embodiment, the engaging part may have a part-spherical shape.

It is possible to engage the drive rod with the piston so that an angle of the drive rod is changeable with respect to the cylinder axis.

In an alternative embodiment, for at least one piston, the piston is fixedly coupled to the drive rod and the piston which has a cylinder-engaging piston ring. At least the piston and/or engaging part rotate in a plane perpendicular to the cam rotation axis, within the cylinder bore. The parts of the piston and piston ring engaging with the cylinder bore are part-spherical in shape. Therefore, as the angle between a drive rod and the axis of the corresponding cylinder varies, the piston continues to sealingly engage with the interior of the cylinder.

In an embodiment, at least one of the holding members and/or at least one of the holding rings may be made of metal.

By forming the holding members and the holding ring made of metal, it is possible to improve the reliability and the strength against repeated change of load caused by the movement of the eccentric cam rotating at high speed.

Preferably, the cylinders, within which the pistons reciprocate, have an internal diameter of less than precisely 45 mm. Typically the cylinders have an internal diameter of less than 44.0 mm. Typically, the vehicle is a car, or truck, fork-lift truck, loader or excavator.

In the above fluid working machine, usually a plurality of the holding members are pressed in a radially outwards direction by the pressing members while being retained by the holding ring. Thus, the drive rods are pressed against the eccentric cam by a reaction force from the pressing members. In this manner, contact is maintained between the drive rods and the eccentric cam, while reducing wear of the drive rods as well as wear of the eccentric cam.

Further, the holding ring can be supported from the inside by the holding members being pressed in a radially outwards direction by the pressing members (the holding ring is not rigidly fixed to any particular part) and thus, the pressing force of each rod being pressed against the eccentric cam can be maintained at almost constant level, regardless of the rotation phase of the eccentric cam. In this manner, fluctuation of the pressing force against the eccentric cam is reduced and thus, it is possible to prevent the wear of the drive rod and the eccentric cam more effectively.

Further, the gap generated between the parts can be maintained by the elastic force of the pressing member.

Therefore, it is unnecessary to manufacture each part with precision higher than necessary, thereby achieving lower manufacturing cost.

DETAILED DESCRIPTION

At least one embodiment of the present invention will now be described in detail with reference to the accompanying drawings. It is intended, however, that unless particularly specified, dimensions, materials, shape, its relative positions and the like shall be interpreted as illustrative only and not limitative of the scope of the present invention.

Figure 1:
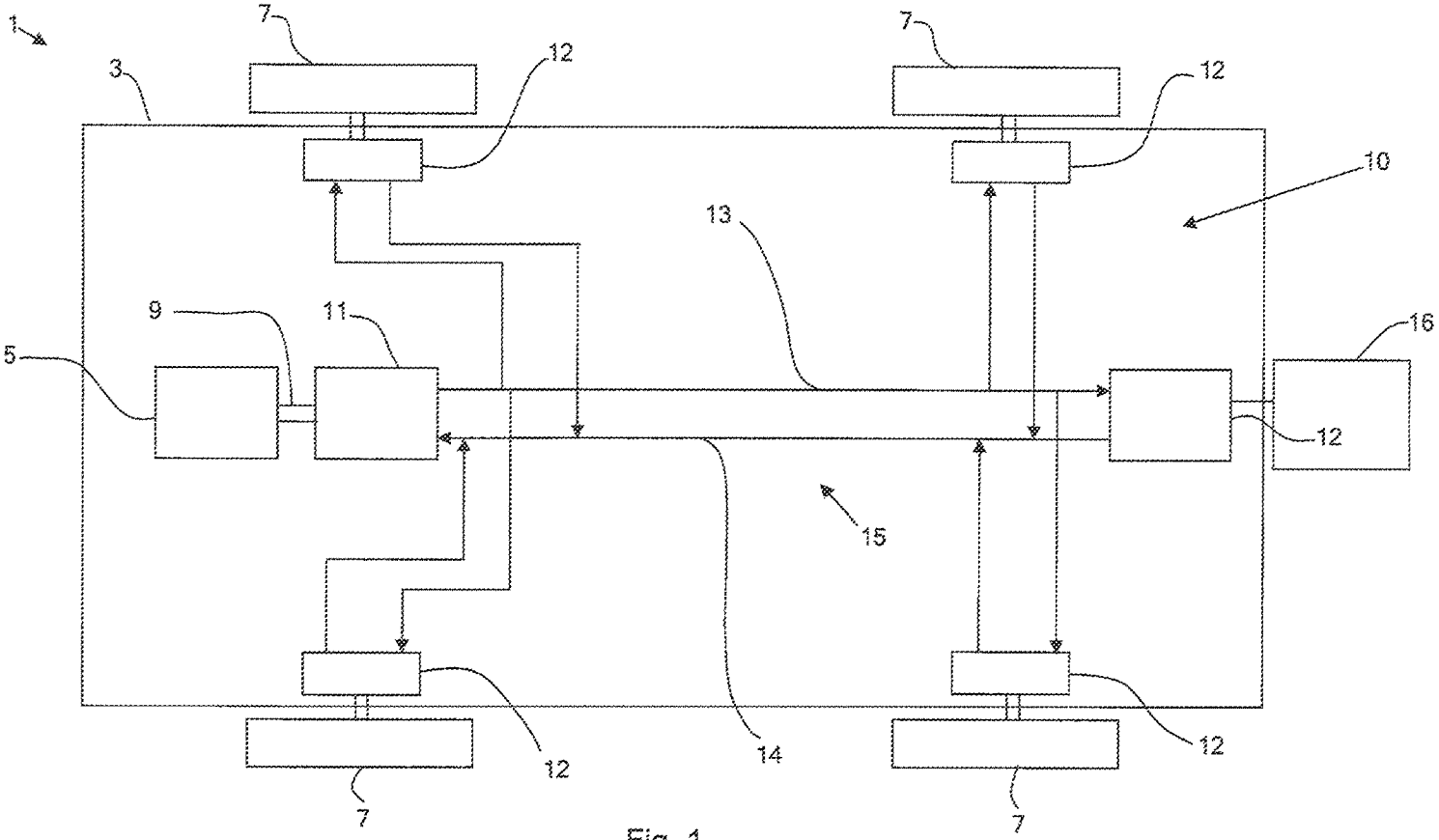
FIG. 1 is a schematic view of an overall structure of an example embodiment of a vehicle.

FIG. 1 is a schematic view of a vehicle. The vehicle 1 has a chassis 3 which houses an engine 5, which may be an internal combustion engine or an electrical engine powered by batteries (not shown). Wheels 7 and one or more other actuated devices 16 (such as fork-lift tine actuators or excavator arms) are also mounted to the chassis. The motor 5 is connected to a rotation shaft 9. The vehicle includes a hydraulic transmission 10 comprising a hydraulic pump 11 connected to the rotation shaft 9, a hydraulic motor 12 connected to each wheel and a further hydraulic actuator 12 which drives the actuated device 16.

The hydraulic transmission further comprises an oil line 15 extending between the hydraulic pump 11 and the hydraulic motors 12. The oil line 15 is formed by a high-pressure oil line 13 for connecting a discharge side of the hydraulic pump 11 to an intake side of the various hydraulic motors 12, and a low-pressure oil line 14 for connecting a discharge side of the various hydraulic motors 12 to an intake side of the hydraulic pump 11.

In the example embodiment of FIG. 1, the same transmission drives both the wheels and another actuated device 16, however, the vehicle may comprise a drive transmission and a separate hydraulic transmission for operating one or more other actuators, or the hydraulic transmission may be used only to drive the wheels, or only to drive other actuators, such as excavator apparatus.

Even in the case of separate hydraulic transmissions, some parts may be shared. For example, a hydraulic pump 11 comprises a plurality of cylinders 19. Some of these cylinders 19 might be part of a first hydraulic transmission, while some other cylinders 19 might be part of a second (third and so on) hydraulic transmission.

The hydraulic pump 11 is driven by the rotation shaft 9 to generate operating oil of high pressure. High pressure oil is supplied to the hydraulic motors 12 via the high pressure oil line 13 to drive the hydraulic motors 12 by the operating oil of high pressure. The operating oil discharged from the hydraulic motors 12 is supplied to the hydraulic pump 11 via the low pressure oil line 14 to pressurize the operating oil again in the hydraulic pump 11 and then the operating oil having been pressurized is supplied to the hydraulic motors 12.

Figure 2:
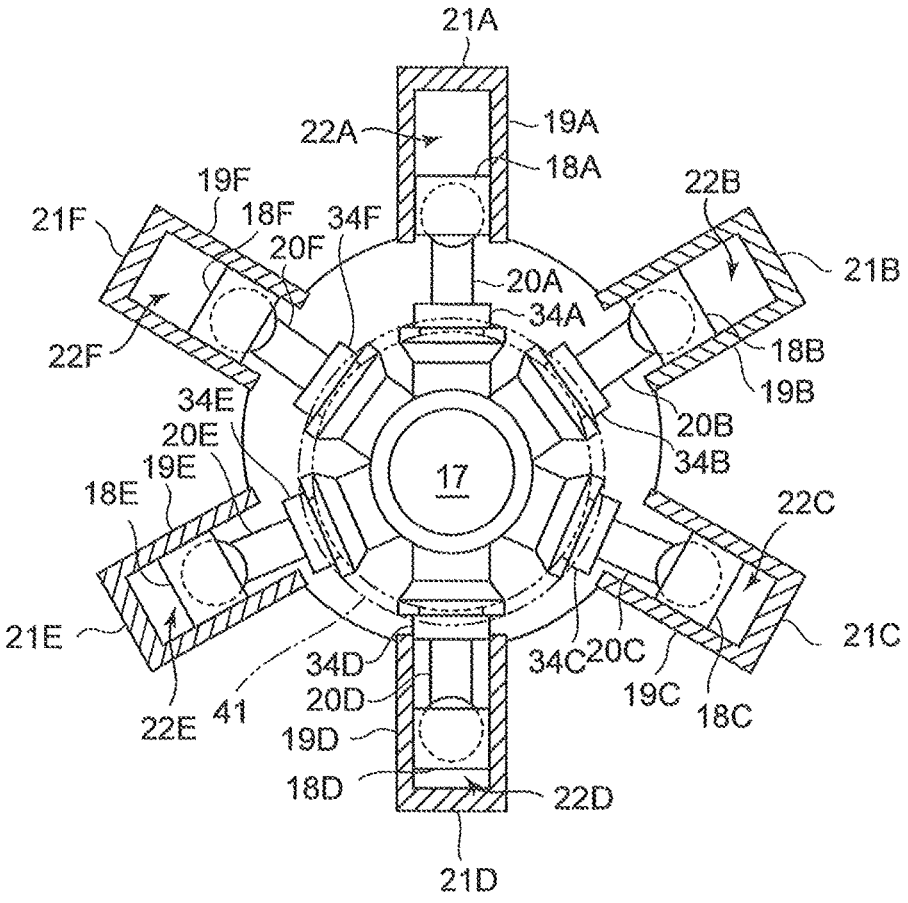
FIG. 2 shows an inner structure of a hydraulic motor

FIG. 2 shows an inner structure of one of the hydraulic motors 12. In the following descriptions, a hydraulic motor 12 is described as one example of the fluid working machine. However, this is not limitative and the structure is also applicable to hydraulic pumps 11. Some hydraulic motors may be operable as a pump or a motor in alternative operating modes.

The hydraulic motor 12 includes an eccentric cam 17 rotating with a rotary shaft of the actuated device 16 (e.g. a wheel 7, or an arm of an excavator etc.), pistons 18A to 18F, cylinders 19A to 19F and drive rods 20A to 20F for transmitting reciprocating motions of the pistons 19A to 19F to the eccentric cam 17. The pistons 18A to 18F and the cylinders 19A to 19F form working chambers 22A to 22F with cylinder heads 21A to 21F, respectively. Although not shown in FIG. 2, the high pressure oil line 13 and the low pressure oil line 14 are connected to each of the working chambers 22A to 22F. By this, supply and discharge of the operating oil in a form of working fluid is performed via a valve mechanism (not shown).

The piston 18A to 18F, the cylinders 19A to 19F and the drive rods 20A to 20F are provided around and extend radially the eccentric cam 17. The pistons 18A to 18F are caused to reciprocate at different phase by the operating oil within the working chambers 22A to 22F and the eccentric cam 17. More specifically, while each of the pistons 18A to 18F moves from a top dead center toward a bottom dead center, the piston 18A to 18F is pressed radially inwardly toward the eccentric cam 17 along a cylinder axis by the operating oil introduced to the corresponding working chamber 22A to 22F from the high pressure oil line 13. In this process, the drive rod 20A to 20F corresponding to the piston 18A to 18F presses the eccentric cam 17, thereby causing an angular movement of the eccentric cam 17. Upon rotation of the eccentric cam 17, the piston 18A to 18F positioned near the bottom dead center is pressed up by the eccentric cam 17 via the drive rod 20A to 20F to discharge the operating oil from the working chamber 22A to 22F to the low pressure oil line 14.

By the periodic reciprocation of the pistons 18A to 18F as described above, the rotary shaft of the generator 16 connected to the eccentric cam 17 rotates.

In the following description, the pistons 18A to 18F are collectively described as the piston 18, the cylinders 19A to 19F are collectively described as the cylinder 19, the drive rods 20A to 20F are collectively described as the drive rod 20, the cylinder heads 21A to 21F are collectively described as the cylinder head 21 and the working chambers 22A to 22F are collectively described as the working chamber 22.

Figure 3A:
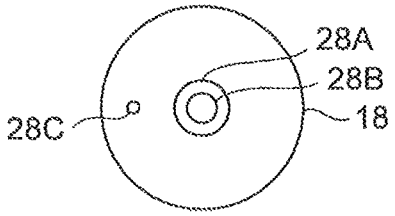
FIG. 3A shows a structure around a piston and a drive rod, which is taken in a radial direction of an eccentric cam from the outside.
Figure 3B:
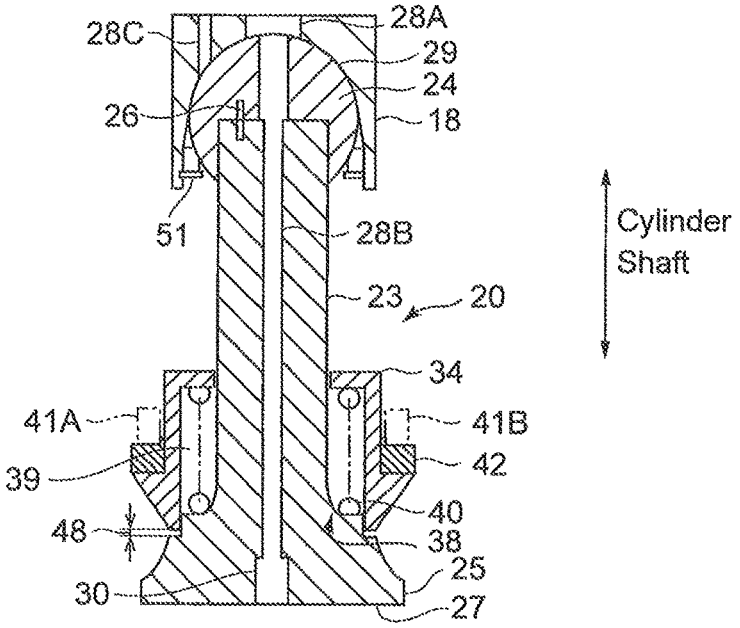
FIG. 3B shows the structure around the piston and the drive rod, which is taken in a circumferential direction of the eccentric cam.
Figure 3C:
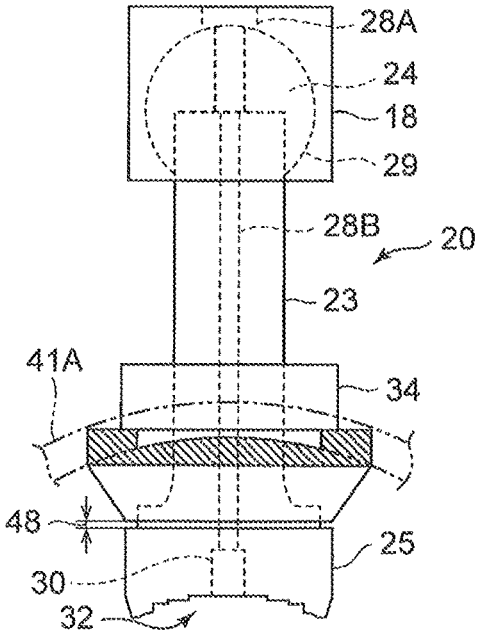
FIG. 3C shows the structure around the piston and the drive rod, which is taken in a rotational direction of the eccentric cam.

FIG. 3A shows a structure around the piston 18 and the drive rod 20 from the outside in a radial direction of the eccentric cam 17. FIG. 3B shows the structure around the piston 18 and the drive rod 20 in a circumferential direction of the eccentric cam 17. FIG. 3C shows the structure around the piston 18 and the drive rod 20 in a rotational direction of the eccentric cam 17.

The drive rod 20 includes a main part 23 extending along the cylinder 19, an engaging part 24 formed at one end of the main part 23 (on an outer side in the radial direction of the eccentric cam 17), and a contact part 25 formed at the other end of the main part 23 (on an inner side in the radial direction of the eccentric cam 17). The main part 23 extends approximately parallel to the radial direction of the eccentric cam 17 and transmits the reciprocating motion of the piston 18 to the eccentric cam side. The main part 23 extends generally axially along the cylinder 19 although the angle at which it extends relative to the axis of the cylinder 19 varies during operation and in some embodiments, the main part 23 does not extend parallel to the axis of the cylinder when the piston is at top dead centre.

The engaging part 24 functions to engage the main part 23 with the piston 18. The engaging part 24 is configured to be held to the piston 18 by a fixing pin 51 from the inside of the radial direction of the eccentric cam 17. In one embodiment, the engaging part 24 has a part-spherical shape.

By the contact part 25 coming into contact with the eccentric cam 17, the reciprocating motion of the piston 18 is converted into the rotating motion of the eccentric cam 17. In one embodiment, the contact part 25 is configured with a diameter larger than the main part 23. By this, the pressing force from the eccentric cam 17 can be transmitted evenly to the piston side via the drive rod 20.

The main part 23 and the contact part 25 are formed integrally, whereas the engaging part 24 is formed as a separate member and fixed to the main part 23 by a bolt 26. Alternatively, the main part 23 and the contact part 25 may be formed separately, the engaging part 24 and the main part 23 may be formed integrally or the contact part 25 may be formed separately while the engaging part 24 is formed integrally.

The hydraulic motor 12 includes a plurality of holding members 34A to 34F. The holding members 34A to 34F are each arranged around the main part 23 of the drive rod 20 to surround the main part 23, extending along the direction of the cylinder axis. In the following description, the holding members 34A to 34F are collectively described as the holding member 34.

The holding members 34A to 34F are held back in radially inwards direction (with respect to the eccentric cam 17) by a ring 41. This causes a contact between the contact surface 27 of the respective drive rod 20 and the eccentric cam 17.

Figure 4A:
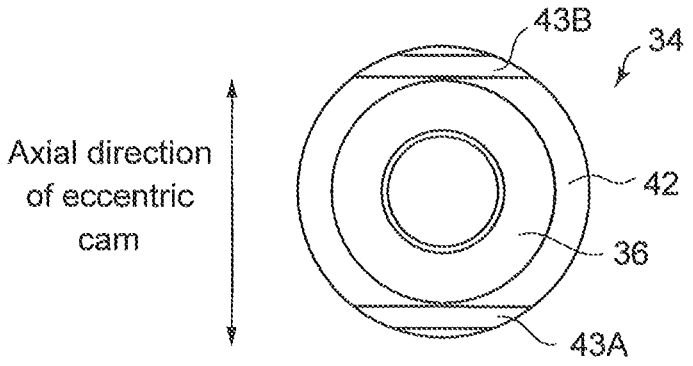
FIG. 4A is a view of a structure of a holding member taken in the radial direction of the eccentric cam from the outside.
Figure 4B:
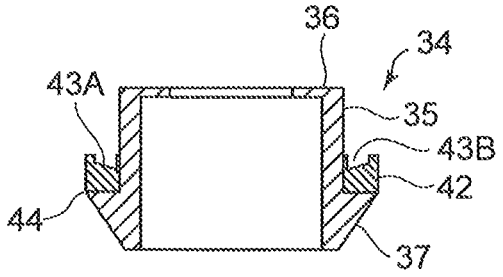
FIG. 4B is a view of the structure of the holding member taken in the circumferential direction of the eccentric cam.
Figure 4C:
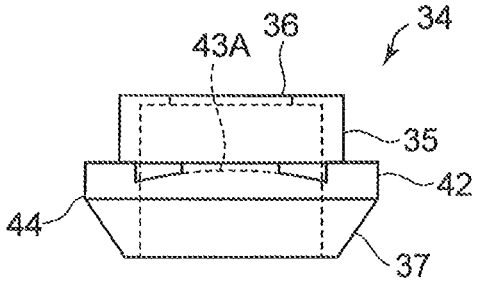
FIG. 4C is a view of the structure of the holding member taken in the rotational direction of the eccentric cam.

FIG. 4A is a view of a structure of the holding member 34 in the radial direction of the eccentric cam 17 from the outside. FIG. 4B is a view of the structure of the holding member 34 in the circumferential direction of the eccentric cam 17. FIG. 4C is a view of the structure of the holding member 34 in the rotational direction of the eccentric cam 17.

The holding member 34 includes a cylindrical part 35 surrounding the main part 23 of the drive rod 20 while extending in the axial direction of the cylinder 19 (radial direction of eccentric cam 17), an inward flange part 36 provided at the radially outwards end of the cylindrical part 35 and an outward flange part 37 provided at the radially inwards end of the cylindrical part 35.

As shown in FIG. 3A to FIG. 3C, a stepped portion 38 is formed on an outer wall of the drive rod 20. In an annular space 39 formed by the stepped portion 38 and the holding member 34, a pressing member 40 is arranged. The pressing member 40 is, for instance, a spring member and presses the inward flange part 36 of the holding member 34 in a direction of moving away from the stepped portion 38.

The pressing member 40 is housed in the annular space 39 surrounded by the cylindrical part 35 of the holding member 34. Thus, during the operation of the hydraulic motor 12, it is possible to prevent the pressing member 40 from interfering with nearby parts, thereby achieving an excellent reliability of the machine.

The outward flange part 37 is provided at the radially inwards end of the cylindrical part 35 (i.e. at the side of the cylindrical part 35 nearer to the eccentric cam 17). Thus, compared to the case where the outward flange part 37 held by the holding ring 41 is formed at the radially outwards end of the cylindrical part 35 (i.e. at the side of the cylindrical part 35 farther from the eccentric cam 17), the attitude of the holding member 34 held by the holding ring 41 becomes stable.

Further, by forming the outward flange part 37 at the radially inwards end of the cylindrical part 35 (i.e. on the side of the cylindrical part 35 nearer to the eccentric cam 17), it is possible to reduce the diameter of the holding ring 41 for holding the outward flange part 37, thereby attaining a more compact holding ring 41.

Between the outward flange part 37 and the drive rod 20 (the stepped portion 38), a clearance 48 is provided. The clearance is set in advance so that, during the normal operation of the hydraulic motor 12, there is still a small gap (for instance, a few millimeters) between the outwards flange part 37 and the drive rod 20 even when the pressing member 40 is in the most compressed state during the operation of the hydraulic motor 12. In this manner, by providing the clearance 48, it is possible to absorb shock caused by a movement of the holding member 34 along the drive rod 20, (thus reducing the wear thereof), and also possible to absorb a manufacturing error of the parts.

In such a case that the hydraulic motor 12 abnormally operates for some reason and the pressing member 40 is deformed beyond an expected range, the outward flange part 37 comes in contact with the drive rod 20 to restrict over-deformation of the pressing member 40. In this manner, even when there is abnormality such as a failure of components, it is possible to restrict the deformation of the pressing member 40 within the expected range and also to prevent the holding ring 41 and the holding member 34 from moving unexpectedly, thereby preventing the abnormality from developing into a significant failure.

A plurality of the pressing member 40 are provided corresponding to the drive rods 20A to 20F. The holding members 34A to 34F are pressed in a radially outwards direction by the pressing members 40A to 40F while being held inwardly by the holding ring 41. Thus, the drive rods 20A to 20F are pressed against the eccentric cam 17 by reaction from the pressing members 40A to 40F. By this, it is possible to maintain the contact between the drive rods 20A to 20F and the eccentric cam 17 regardless of the rotation phase of the eccentric cam 17. Therefore, it is possible to reduce the wear of the drive rods 20A to 20F as well as the wear of the eccentric cam 17. In the following description, the pressing members 40A to 40F are collectively described as the pressing member 40.

Between the holding ring 41 and the outward flange part 37, a slide member 42 may be provided. As shown in FIG. 4A to FIG. 4C, the slide member 42 may be formed to partially surround the cylindrical part 35 along the outward flange part 37. The holding ring 41 is not fixed to the holding member 34 and thus, during the operation of the hydraulic motor 12, the holding ring 41 moves with respect the holding member 34 to some extent in response to the rotation of the eccentric cam 17. For instance, the drive rod 20 contacts the eccentric cam 17 and operates while changing its angle with respect to the cylinder axis. In response to this, the holding ring 41 is subjected to an abrasion force to some extent via the holding member 34 provided on the drive rod 20 and rotates frontward and rearward in the circumferential direction of the holding ring 41.

The slide member 42 is, for instance, made of PEEK material (Polyether ether ketone). By arranging this slide member 42 between the holding ring 41 and the holding member 34, it is possible to reduce the wear of the holding ring 41 and the holding member 34.

Further, the slide member 42 can be attached to the outward flange part 37 by adhesive 44.

In the slide member 34, a groove 43 is formed, extending along the circumferential direction of the eccentric cam 17. By fitting the holding ring 41 in the groove 43, it is possible to regulate the position of the holding ring 41. By this, during the operation of the hydrulic motor 21, the holding ring 41 is prevented from coming off from the holding member 34. As a result, it is possible to improve the reliability of the machine.

The groove 43 is formed in the outward flange part 37 on both side of the cylindrical part 35, i.e. the grooves 43A and 43B being formed on both sides of the cylinderical part 35, respectively. In each of the grooves 43A, 43B, a corresponding one of the holding rings 41A, 41B is fitted. In this manner, by forming the groove 43 on each side of the cylindrical part 35 so that the holding ring 41 is fit therein, the attitude of the holding member 34 held by the holding ring 41 can be stable.

The holding member 34 and the holding ring 41 are, for instance, made of metal. The holding member 34 may be made of aluminium and the holding ring 41 may be made of iron.

Figure 5A:
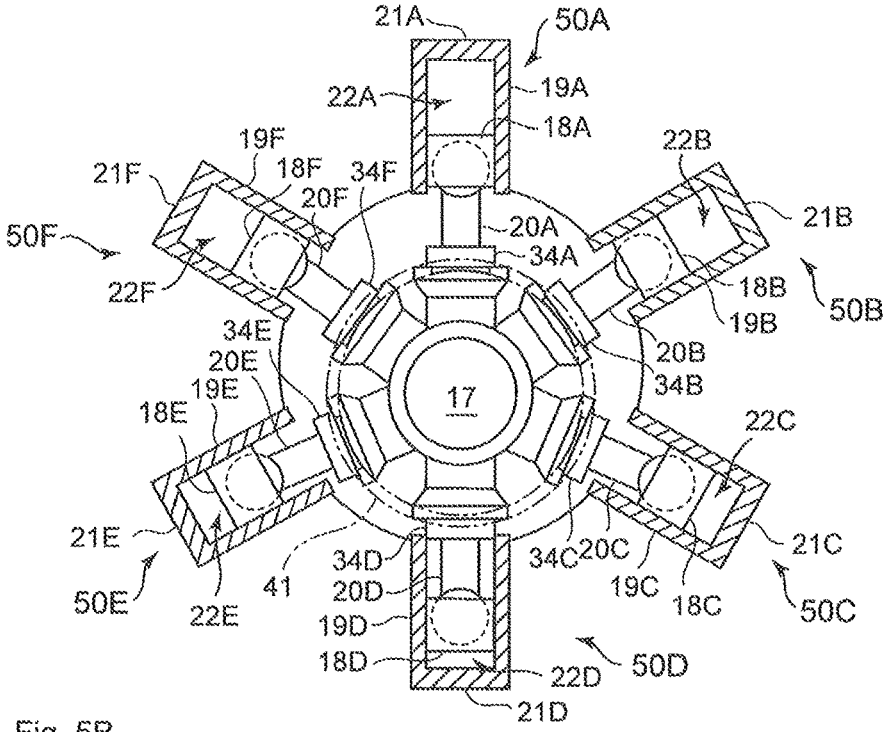
FIG. 5A shows movement of component parts of a hydraulic motor in response to a rotation of the eccentric cam.
Figure 5B:
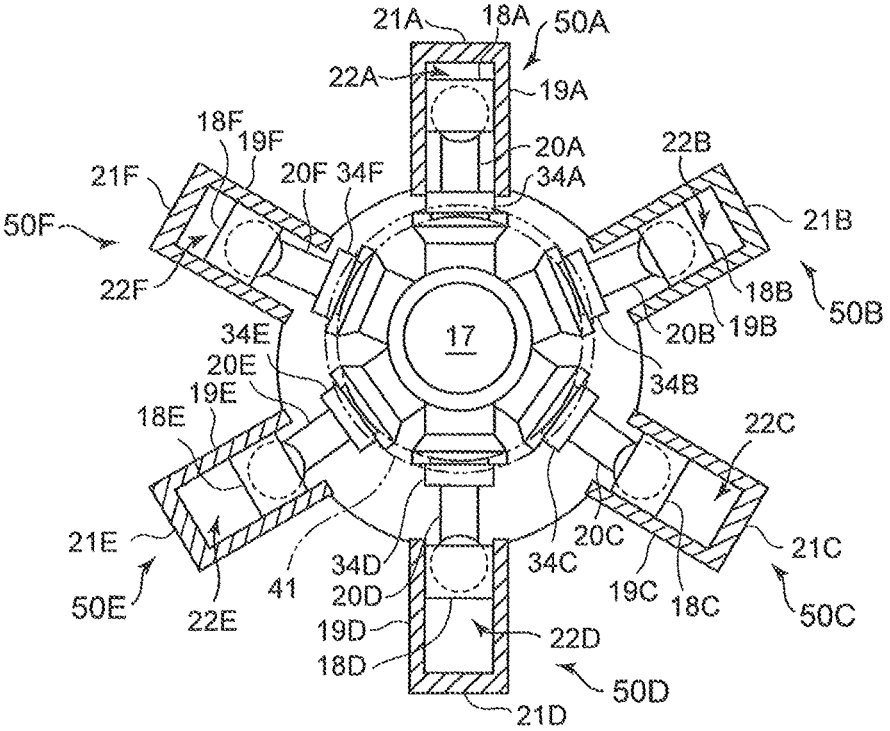
FIG. 5B shows movement of component parts of the hydraulic motor in response to a rotation of the eccentric cam, with 180 degree phase shift from the case of FIG. 5A.

FIG. 5A is a schematic view showing movement of component parts in the hydraulic motor 12 in response to the rotation of the eccentric cam 17. FIG. 5B is a schematic view showing movement of the component parts in the hydraulic motor 12 in response to the rotation of the eccentric cam 17 in such a state that the phase of the eccentric cam 17 is shifted by 180 degrees from the case of FIG. 5A. To simplify the description, a unit 50A having the piston 18A, the cylinder 19A, the drive rod 20A, the working chamber 22A, the holding member 34A and the pressing member 40A and a unit 50D having the piston 18D, the cylinder 19D, the drive rod 20D, the working chamber 22D, the holding member 34D and the pressing member 40D are explained. The description is, of course, applicable to the other units 50.

In the embodiment, even numbers of the units are provided. However, this is not limitative and odd numbers of the units 50 may be provided. Further, the units are arranged symmetrically with respect to a center of the eccentric cam 17. However, this is not limitative and the units may be arranged asymmetrically.

FIG. 5A is explained below.

In the hydraulic motor 12, the eccentric cam 17 rotates with the rotary shaft of the actuated device 16 (e.g. wheel 7). In the unit 50A, the rotation of the eccentric cam 17 presses up the drive rod 20A outwardly in the radial direction of the eccentric cam 17. While being pressed up, the drive rod 20A presses the holding ring 41 outwardly in the radial direction of the eccentric cam 17 via the pressing member 40A. In this manner, the holding ring 41 moves in an upward direction in FIG. 5A.

In contrast, in the unit 50D with the phase opposite to the unit 50A, the drive rod 20D is not pressed against the eccentric cam 17 (depending on a situation, the drive rod 20D moves away from the eccentric cam 17). Meanwhile, the holding ring 41 moves in the upward direction in FIG. 5A as described above, causing the holding member 34D to be pressed in a radially inwards direction. In this manner, the force acting to press down the holding member 34D is transmitted to the drive rod 20D via the pressing member 40D. By this, the drive rod 20D is pressed against the eccentric cam 17, thereby maintaining the contact therebetween.

FIG. 5B is explained below.

In a fashion opposite to FIG. 5A, in the unit 50D, the rotation of the eccentric cam 17 presses the drive rod 20D in a radially outwards direction. While being pressed up, the drive rod 20D presses the holding ring 41 in a radially outwards direction via the pressing member 40A. In this manner, the holding ring 41 moves in a downward direction in FIG. 5B.

In contrast, in the unit 50A with the phase opposite to the unit 50D, the drive rod 20A is not pressed against the eccentric cam 17 (depending on a situation, the drive rod 20A moves away from the eccentric cam 17). Meanwhile, the holding ring 41 moves in the downward direction in FIG. 5B as described above, causing the holding member 34A to be pressed in a radially inwards direction. In this manner, the force acting to press down the holding member 34A is transmitted to the drive rod 20A via the pressing member 40A. By this, the drive rod 20A is pressed against the eccentric cam 17, thereby maintaining the contact therebetween.

As shown in FIG. 5A and FIG. 5B, in response to the rotating motion of the eccentric cam 17, the holding ring 41 rotates around approximately the same axis with the eccentric cam 17. In this manner, the holding ring 41 holds the holding members 34A to 34F pressed in a radially inwards direction by the pressing members 40A to 40F and the holding ring 41 is not fixed rigidly to any particular part. Therefore, the pressing members 40A to 40F are not compressed or extended significantly in response to the rotation of the eccentric cam 17. Compared to the case where the ends of the pressing members 40A to 40F are rigidly fixed to a particular part, the pressing members 40A to 40F are compressed or extended less. Regardless of the rotation phase of the eccentric cam 17, it is possible to maintain the drive rods 20A to 20F in contact with the eccentric cam 17 with approximately the constant amount of force. As a result, it is possible to reduce the wear of the eccentric cam 17 and the drive rod 20, thereby attaching enhanced lifetime thereof.

Further, by arranging the pressing members 40A to 40F in the hydraulic motor 12, the gap possibly generated between the drive rods and the holding members can be filled. Therefore, it is unnecessary to manufacture each of the parts with precision beyond necessity, thereby achieving lower manufacturing cost.

In FIG. 3A to FIG. 3C, an inner passage 28 is formed in the piston 18 and the drive rod 20 to supply the operating oil from the working chamber 22 to a contact surface of the drive rod 20 with the eccentric cam 17. The inner passage 28 includes a first inner passage 28A formed in the piston 28, and a second inner passage 28B formed in the drive rod 20. The first inner passage 28A and the second inner passage 28B communicate with each other to supply the operating oil introduced from the working chamber 22 to the contact surface 27.

The first inner passage 28A has a greater cross-sectional area than the second inner passage 28B. By this, even when the drive rod 20 is inclined with respect to the cylinder axis, it is possible to maintain the communication between the first inner passage 28A and the second inner passage 28B. As a result, it is possible to supply the operating oil to the contact surface 27 regardless of the rotation phase of the eccentric cam 17, thereby reducing the wear of the contact surface 27 effectively.

A third inner passage 28C is also formed in the piston 18 to supply the operating oil from the working chamber 22 to an engaging surface 29 which the piston 18 and the drive rod 20 (the engaging part 24) slide against. By this, a fluid film is formed on the engaging surface 29, thereby reducing the wear of the piston 18 and the drive rod 20.

In the second inner passage 28B, an orifice 30 is provided to regulate a flow of the operating oil introduced from the working chamber 22. By this, it is possible to regulate the flow of the operating oil to the contact surface so as to achieve a favorable effect of reducing the wear the contact surface 27.

Further, in the example shown in FIG. 3A to FIG. 3C, the orifice 30 is provided in the second inner passage 28B. However, this is not limiting and the orifice 30 may be provided in one or both of the second inner passage 28A and the third inner passage 28C instead of or in addition to the second inner passage 28B.

On a surface of the drive rod 20 (the contact part 25) facing the eccentric cam 17, the surface is recessed to form a working sump 32 in an area including the opening 32 of the inner passage 28. In the working sump 32, the operating oil is supplied from the working chamber 22 via the inner passage 28. The operating oil stored in the working fluid sump 32 leaks about from the working fluid sump 32 to form the fluid film on the contact surface 27. In this manner, the fluid film is formed on the contact surface 27, thereby reducing the wear in the contact surface 27.

Figure 6A:
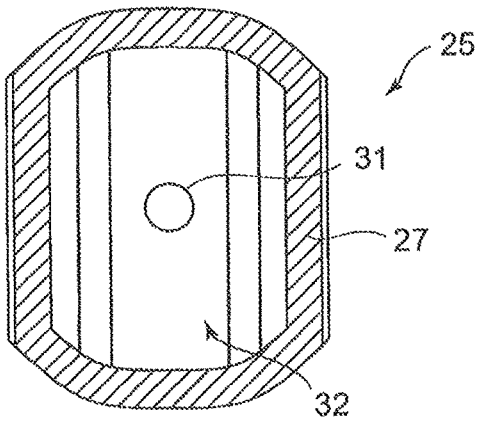
FIG. 6A shows a configuration of a working fluid sump in the radial direction of the eccentric cam from the inside.
Figure 6B:
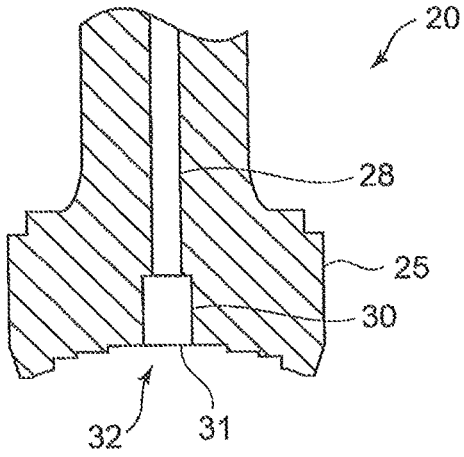
FIG. 6B shows the configuration of the working fluid sump in the circumferential direction of the eccentric cam.

FIG. 6A shows a configuration of the working fluid sump 32 in a radial direction from the inside. FIG. 6B shows the configuration of the working fluid sump 32 in the circumferential direction of the eccentric cam 17. The working fluid sump 32 is formed so that its depth changes in a stepped manner along the circumferential direction of the eccentric cam 17. By this, it is possible to attain high strength of the contact part 25 of the drive rod 20 when the working fluid sump 32 is formed by recessing the surface of the drive rod 20 (the contact pat 25) facing the eccentric cam 17.

Figure 7:
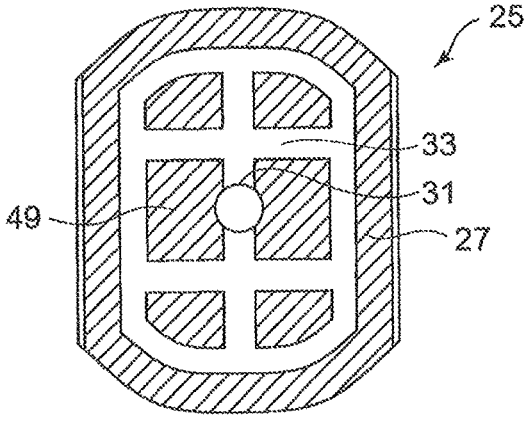
FIG. 7 shows another example configuration of the working fluid sump.

FIG. 7 shows another example configuration of the working fluid sump 32. In FIG. 7, the working fluid sump 32 may be formed with a groove 33 for communicating with the opening 31 of the inner passage 28. The groove 33 communicates with the opening 31 of the inner passage 28 to supply the operating oil from the working chamber 22. The operating oil leaks out from the groove 33 extending in a prescribed direction, thereby spreading over the contact surface 27. By this, the fluid film is formed on the contact surface 27 and the wear is effectively reduced.

Particularly in the example of FIG. 7, the working fluid sump 32 is formed by surrounding a prescribed area of a land 49 by the groove 33. This allows the operating oil supplied to the working fluid sump 32 to spread effectively over a large area of the contact surface 27 and the land 49.

Figure 8:
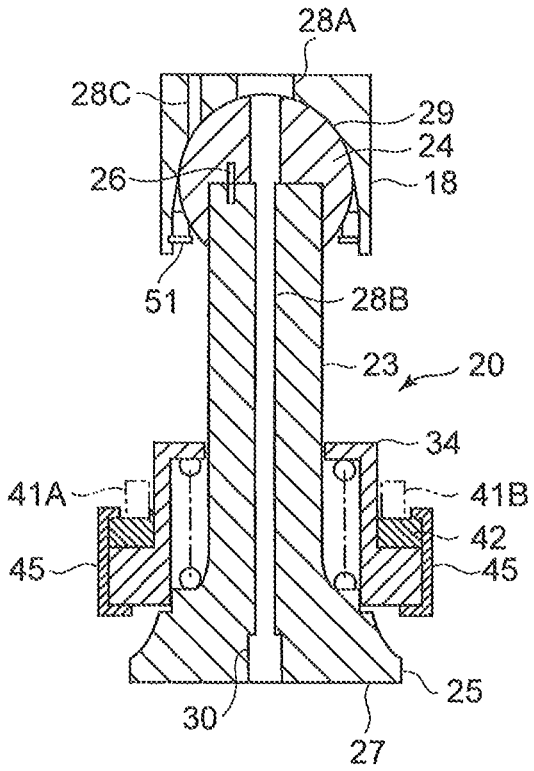
FIG. 8 shows another embodiment in which a slide member is fixed using a clamp member.

In the above embodiments, the slide member 42 is fixed to the outward flange part 37 by adhesive 44. However, this is not limitative and instead, the slide member 42 and the outward flange part 37 may be clamped from outside and fixed by a clamp member 45, as shown in FIG. 8.

Figure 9:
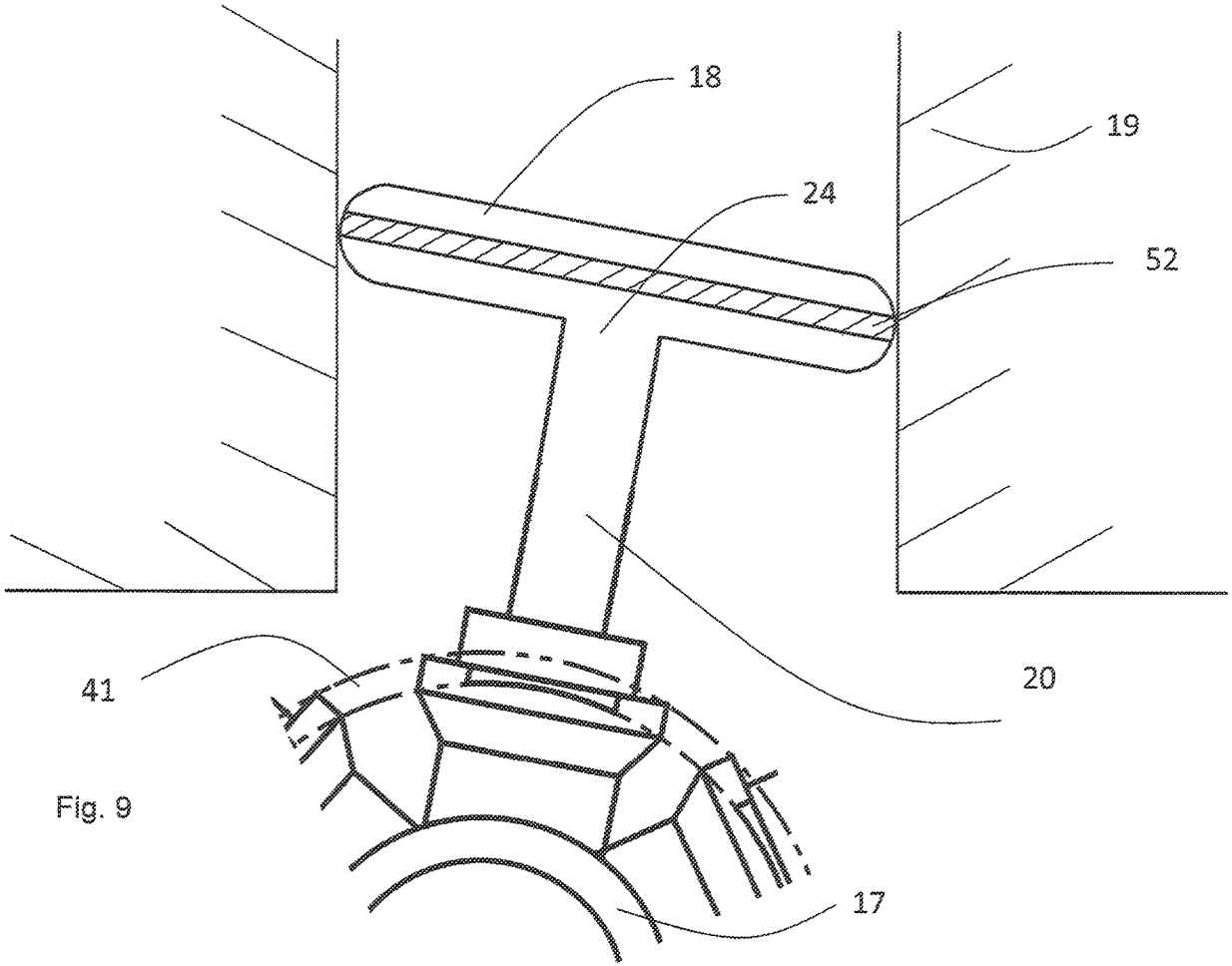
FIG. 9 is a schematic diagram (not to scale) of an alternative embodiment in which the piston has a part-spherical cylinder-engaging piston ring.

In an alternative embodiment shown in FIG. 9, the engaging part 24 of the drive rod 20 is fixedly coupled to a piston 18 which is fixedly coupled to the drive rod. The piston has a part-spherical cylinder-engaging piston ring 29. At least the piston and/or engaging part, rotate relative to the cam rotation axis, within the cylinder bore. The piston may be part-spherical in shape. The piston ring may be part-spherical in shape. Therefore, as the angle between the drive rod 20 and the cylinder axis varies as the eccentric cam 17 turns, the piston ring 52 continues to sealingly engage with the interior of the cylinder.

While the present invention has been described with reference to the exemplary embodiments, it is obvious to those skilled in the art that various changes may be made without departing from the scope of the invention.

What is claimed is:

1. A device comprising:

a hydraulic pump;

a hydraulic actuator which is driven by pressurized oil supplied from the hydraulic pump;

wherein at least one of the hydraulic pump and the hydraulic actuator is a fluid working machine which comprises:

an eccentric cam;

a plurality of pistons arranged radially around the eccentric cam;

a plurality of cylinders provided for the plurality of pistons, respectively, each of the pistons being configured to reciprocate along a radial direction of the eccentric cam by rotation of the eccentric cam;

a plurality of drive rods which are provided for the plurality of pistons, respectively, and wherein at least one of said drive rods comprises:

a main part that extends along a corresponding one of the cylinders;

an engaging part that is formed at one end of the main part and is engaged with corresponding one of the pistons;

a contact part that is formed at the other end of the main part and contacts the eccentric cam;

a holding member that is arranged about the main part and extends along the axial direction of the drive rod;

a pressing member which presses the holding member, outward in the radial direction of the eccentric cam; and at least one holding ring which is arranged on the radially outwards side of the holding member to hold the holding member from the radially outwards side of the holding member.

2. The device according to claim 1, wherein the holding member comprises a cylindrical part surrounding the main part and an inward flange part provided at the radially outwards end of the cylindrical part, wherein the contact part has a diameter larger than the main part so that a stepped portion is formed between the contact part and the main part, wherein the pressing member is arranged in an annular space formed between an inner surface of the cylindrical part and an outer surface of the main part to press the inward flange part in a direction apart from the stepped portion.

3. The device according to claim 2, wherein the holding member comprises a pair of grooves on both sides of the cylindrical part, and wherein the fluid working machine comprises a pair of holding rings which are fitted in the pair of grooves, respectively.

4. The device according to claim 2, wherein an inner passage is formed in at least one of the plurality of pistons and/or at least one of the plurality of drive rods to supply working fluid from the working chamber to a contact surface of the contact part with the eccentric cam.

5. The device according to claim 1, wherein the holding member comprises a cylindrical part surrounding the main part and an outward flange part provided at the radially inwards end of the cylindrical part, and wherein the at least one holding ring holds the outward flange part of the holding member.

6. The device according to claim 5, wherein the outward flange part of the holding member comprises a groove, and wherein the at least one holding ring is fitted within the groove.

7. The device according to claim 6, wherein the holding member comprises a pair of grooves on both sides of the cylindrical part, and wherein the fluid working machine comprises a pair of holding rings which are fitted in the pair of grooves, respectively.

8. The device according to claim 6, wherein an inner passage is formed in at least one of the plurality of pistons and/or at least one of the plurality of drive rods to supply working fluid from the working chamber to a contact surface of the contact part with the eccentric cam.

9. The device according to claim 5, wherein the holding member comprises a pair of grooves on both sides of the cylindrical part, and wherein the fluid working machine comprises a pair of holding rings which are fitted in the pair of grooves, respectively.

10. The device according to claim 5, wherein an inner passage is formed in at least one of the plurality of pistons and/or at least one of the plurality of drive rods to supply working fluid from the working chamber to a contact surface of the contact part with the eccentric cam.

11. The device according to claim 1, wherein the holding member comprises a pair of grooves on both sides of the cylindrical part, and wherein the fluid working machine comprises a pair of holding rings which are fitted in the pair of grooves, respectively.

12. The device according to claim 11, wherein an inner passage is formed in at least one of the plurality of pistons and/or at least one of the plurality of drive rods to supply working fluid from the working chamber to a contact surface of the contact part with the eccentric cam.

13. The device according to claim 1, wherein an inner passage is formed in at least one of the plurality of pistons and/or at least one of the plurality of drive rods to supply working fluid from the working chamber to a contact surface of the contact part with the eccentric cam.

14. The device according to claim 13, wherein an orifice is provided in said inner passage to regulate a flow of the working fluid.

15. The device according to claim 1, wherein a surface of at least one of the plurality of drive rods facing the eccentric cam includes a recessed portion which is surrounded by a stepped boundary around an opening of the inner passage and which is configured to function as a working fluid sump, the stepped boundary separating the recessed portion from the contact surface.

16. The device according to claim 15, wherein the working fluid sump is formed so that a depth of the working fluid sump changes in a stepped manner in a circumferential direction of the eccentric cam.

17. The device according to claim 1, wherein a surface of at least one of the plurality of drive rods facing the eccentric cam includes a groove to which the inner passage opens and which is configured to function as a working fluid sump.

18. The device according to claim 1, wherein at least one of the plurality of pistons is fixedly coupled to a respective one of the plurality of drive rods and has a cylinder-engaging piston ring.

19. The device according to claim 1, wherein there is a gap between the holding member and the respective contact part during normal operation.

20. The device according to claim 1, wherein the holding member comprises a cylindrical part surrounding the main part and an outward flange part provided at the radially inwards end of the cylindrical part, and wherein the at least one holding ring holds the outward flange part of the holding member.

* * * * *